US009512786B2

(12) United States Patent
Le Forestier

(10) Patent No.: US 9,512,786 B2
(45) Date of Patent: Dec. 6, 2016

(54) VALVE ACTUATION MECHANISM AND AUTOMOTIVE VEHICLE EQUIPPED WITH SUCH A VALVE ACTUATION MECHANISM

(71) Applicant: RENAULT TRUCKS, Saint-Priest (FR)

(72) Inventor: Romain Le Forestier, Reyrieux (FR)

(73) Assignee: Renault Trucks, St. Priest (FR)

( * ) Notice: Subject to any disclaimer, the term of this patent is extended or adjusted under 35 U.S.C. 154(b) by 23 days.

(21) Appl. No.: 14/423,617

(22) PCT Filed: Sep. 25, 2012

(86) PCT No.: PCT/IB2012/002412

§ 371 (c)(1),
(2) Date: Feb. 24, 2015

(87) PCT Pub. No.: WO2014/049388

PCT Pub. Date: Apr. 3, 2014

(65) Prior Publication Data

US 2015/0204250 A1 Jul. 23, 2015

(51) Int. Cl.

| | |
|---|---|
| ***F02D 13/04*** | (2006.01) |
| ***F01L 13/06*** | (2006.01) |
| ***F02D 13/02*** | (2006.01) |
| *F01L 1/08* | (2006.01) |

(52) U.S. Cl.

CPC ..... *F02D 13/04* (2013.01); *F01L 13/065* (2013.01); *F02D 13/0242* (2013.01); *F01L 1/08* (2013.01)

(58) Field of Classification Search

CPC .. F02D 13/04; F02D 13/0242; F01L 13/065; F01L 1/08

USPC ..... 123/321, 90.11–90.59

See application file for complete search history.

(56) References Cited

U.S. PATENT DOCUMENTS

| | | | | |
|---|---|---|---|---|
| 5,794,589 | A * | 8/1998 | H.ang.kansson | F01L 1/181 123/321 |
| 5,809,952 | A * | 9/1998 | Ono | F01L 1/181 123/182.1 |
| 5,829,397 | A * | 11/1998 | Vorih | F01L 1/181 123/198 D |
| 5,890,469 | A * | 4/1999 | H.ang.kansson | F01L 13/06 123/321 |
| 6,283,090 | B1 * | 9/2001 | Harmon | F01L 1/053 123/321 |

(Continued)

FOREIGN PATENT DOCUMENTS

| | | |
|---|---|---|
| WO | 9009514 | 8/1990 |
| WO | 91/08381 A1 | 6/1991 |

(Continued)

OTHER PUBLICATIONS

International Searth Report (Jun. 21, 2013) for corresponding International App. PCT/IB2012/002412.

*Primary Examiner* — Joseph Dallo
(74) *Attorney, Agent, or Firm* — WRB-IP LLP

(57) ABSTRACT

A valve actuation mechanism includes a rocker adapted for opening a cylinder valve, via an activation piston movable in a piston chamber of the rocker under action of a fluid pressure raise in the piston chamber, from a first position in which an engine operating function is deactivated to a second position, in which the engine operating function is performed, the rocker including a controlled blocking valve, wherein the control of the blocking, valve between its open state and its blocking state is performed by action of a force exerted by the fluid pressure in the piston chamber on a valve member of the blocking valve which is exposed to the fluid pressure in the piston chamber.

22 Claims, 6 Drawing Sheets

(56) References Cited

U.S. PATENT DOCUMENTS 6,439,195 B1 * 8/2002 Warner ..... F01L 13/06 123/320
6,450,144 B2 9/2002 Janak et al.
6,594,996 B2 * 7/2003 Yang ..... F02M 26/01 123/321
6,655,349 B1 * 12/2003 Cavanagh ..... F01L 1/181 123/321
6,732,686 B1 * 5/2004 Maeda ..... F01L 1/18 123/321
6,866,017 B2 * 3/2005 Ruggiero ..... F01L 13/06 123/321
6,925,976 B2 * 8/2005 Israel ..... F01L 1/08 123/321
6,953,021 B2 * 10/2005 Wakashiro ..... B60K 6/48 123/198 F
8,042,502 B2 * 10/2011 Schnell ..... F01L 1/2405 123/321
8,065,987 B2 * 11/2011 Yang ..... F01L 1/08 123/321
8,146,566 B2 * 4/2012 Lee ..... F01L 13/065 123/321
8,210,144 B2 * 7/2012 Langewisch ..... F01L 1/14 123/321
2001/0027773 A1 * 10/2001 Janak ..... F01L 1/181 123/321
2003/0024501 A1 * 2/2003 McCarthy ..... F01L 13/065 123/321
2004/0206331 A1 * 10/2004 Leman ..... F01L 9/02 123/321
2004/0237932 A1 * 12/2004 Persson ..... F01L 13/06 123/321
2005/0000498 A1 * 1/2005 Persson ..... F01L 1/18 123/568.14
2005/0274341 A1 12/2005 Usko et al.
2006/0081213 A1 * 4/2006 Yang ..... F02M 26/01 123/321
2007/0144472 A1 * 6/2007 Yang ..... F01L 1/08 123/90.16
2007/0277779 A1 * 12/2007 McClure ..... F01L 9/025 123/322
2010/0006062 A1 * 1/2010 Yang ..... F01L 1/181 123/321
2010/0170472 A1 * 7/2010 Yang ..... F01L 1/08 123/321
2010/0319657 A1 * 12/2010 Dodi ..... F01L 13/065 123/321
2011/0079196 A1 * 4/2011 Kraft ..... F01L 1/24 123/321
2011/0120411 A1 * 5/2011 Ren ..... F01L 1/26 123/321

FOREIGN PATENT DOCUMENTS

WO 01/18373 A1 3/2001
WO 01/20150 A1 3/2001

* cited by examiner

VALVE ACTUATION MECHANISM AND AUTOMOTIVE VEHICLE EQUIPPED WITH SUCH A VALVE ACTUATION MECHANISM

BACKGROUND AND SUMMARY

The invention concerns a valve actuation mechanism for an internal combustion engine on an automotive vehicle. The invention also concerns an automotive vehicle, such as a truck, equipped with such a valve actuation mechanism.

Automotive vehicles, such as trucks, often rely on an engine brake system to slow down in order, for example, to reduce wear of the friction brake pads and to prevent overheating of the friction brakes, particularly on downward slopes. It is known to perform engine brake by acting on the amount of gas present in the cylinders of the engine in two distinct phases. In a first phase, when the pistons are near a bottom dead center, one injects exhaust gases into the chambers of the cylinders so as to slow down the pistons when they move towards their high level. This is done by slightly opening at least a valve connected to an exhaust manifold, while exhaust gases are prevented to be expelled from the exhaust pipe and thereby at a certain pressure above atmospheric pressure. In the second phase, the gases which are compressed the piston are expelled from the chamber of the cylinder when the piston is at or near its top dead center position in order to prevent an acceleration of the piston under effect of volumic expansion of compressed gas. This is done by slightly opening a valve so as to expel gases from the cylinder. In most cases, the valve (or valves) which is (are) opened for the engine brake function is (are) a main exhaust valve. Such an engine brake system is described in document WO-A-9009514.

To perform these engine brake valves movements, also called engine brake valves lifts, the engine comprises, for each cylinder, a rocker acting, on the valves to open and close them. The rocker is acted upon by a rotating cam which has at least one lift sector to cause the lifting (opening) of the valve. If the valve is also an exhaust or an intake valve, the corresponding cam will comprise a main valve lift sector and one or several auxiliary valve lift sectors, also called main valve lift bump and auxiliary valve lift bump. When engine brake is needed, a cam follower surface of the rocker is moved in close contact with a cam of a camshaft moving the rocker, so that the brake movements of the valve are obtained when the cam follower interacts with the auxiliary valve lift sectors. In normal operating conditions of the engine, the valves should not perform these movements and the roller of the rocker is kept slightly remote from the cam, so that the cane follower does not interact with the auxiliary valve lift sectors. The distance or clearance between the roller and the cam ensures that only the larger main lift sector on the cam, dedicated to the main exhaust event, causes an opening of the exhaust valve, but not one or several smaller auxiliary lift sectors dedicated to the engine brake function. This clearance is suppressed when engine brake is needed, by moving an activation piston of the rocker to make a close contact between the roller and the cam, so that engine brake dedicated lift sectors on the cam also cause an opening of the valve. An engine brake system having such valve actuation mechanism is described in WO-A-91/08381.

Engine brake systems generally comprise a control valve to direct pressurized control fluid pressure in a chamber adjacent to the piston to move the activation piston from its initial position to its engine brake actuation position. The control valve controls whether or not the engine brake function is activated. This control valve lets pressurized, control fluid flow, at a pressure of for example 2 to 5 bars, towards each rocker as long as the engine brake function is needed, which typically lasts several seconds or tens of seconds during which the engine and the cam shaft may perform several hundreds or thousands of complete revolutions.

Some know systems comprise, in the rocker, a controlled blocking valve comprising a regular ball check valve, for effectively blocking fluid flow in the direction from the piston chamber to the fluid feeding circuit, and a state switching piston which is spring braised towards a position where it pushes the ball of the ball check valve off its seat. The blocking valve as whole is thereby in an open state. When a certain pressure is delivered by the control valve, the pressure pushes the state switching piston to a retracted position, which allows the ball check valve to operate conventionally. The blocking valve as a whole is then in a blocking state. The state switching piston is located upstream of the ball valve, so that when the ball valve is closed, it is controlled by a pressure which is the pressure delivered by the control valve, which pressure may different than the pressure in the piston chamber. Such systems require a quite complex design of the blocking valve.

In U.S. Pat. No. 6,450,144, various designs of a controlled blocking valve are provided to prevent or limit fluid flow out of the chamber when the piston is in its engine brake actuation position. This blocking valve is permanently controlled using a control pressure coming from the upstream portion of the fluid circuit leading to the blocking valve.

It is desirable to propose a new valve actuation mechanism for an automotive vehicle, in which the blocking valve is simpler in design.

To this end, the invention concerns, according to an aspect thereof, a valve actuation mechanism for an internal combustion engine on an automotive vehicle, comprising at least one rocker adapted to exert a valve opening force on at least a portion of an opening actuator for opening a cylinder valve, via an activation piston of the rocker movable in a piston chamber of the rocker under action of a fluid pressure raise in the piston chamber, from a first position, in which an engine operating function is deactivated, to a second position, in which said engine operating, function is performed, the rocker comprising a controlled blocking valve having an open state allowing bidirectional fluid flow between a fluid feeding circuit of the rocker and the piston chamber, and as blocking state to block, fluid flow from the piston chamber to the fluid feeding circuit to block the activation piston is in its second position, wherein the control of the blocking valve between its open state and its blocking state is performed by action of a force exerted by the fluid pressure in the piston chamber on a valve member of the blocking valve which is exposed to the fluid pressure in the piston chamber.

According to further aspects of the invention which are advantageous but not compulsory, such a valve actuation mechanism can incorporate one or several of the following features:

- The controlled blocking valve comprises a single unitary moveable valve member, which controls both the state of the blocking valve and the effective fluid flow from the piston chamber to the fluid feeding circuit.
- The valve member is exposed to the fluid pressure in such a way that, at least when the valve member is in a first position allowing bidirectional fluid flow through the blocking valve, the resulting force of the fluid pressure on the valve member tends to move the valve member towards a second position blocking fluid flow to the fluid feeding circuit through the blocking valve.

The area of surfaces of the valve member which are exposed to the fluid pressure are dimensioned so that, at least when the valve member is in the first position, the resulting force of the fluid pressure on the valve member tends to move the valve member towards its second position.

The valve member is movable in a valve chamber which is in fluidic communication with the chamber of the activation piston and with a main fluid feeding duct.

The first position of the valve member corresponds to the open state of the controlled blocking valve, in which the main fluid feeding duct is fluidly connected to the piston chamber, and the second position of the valve member corresponds to the blocking state of the controlled blocking valve, in which the main fluid feeding duct and the piston chamber are fluidly disconnected.

The valve member defines in the valve chamber a fluid pressure compartment which is permanently fluidly connected to the piston chamber so as to be permanently at the same pressure as the piston chamber.

The valve chamber and the valve member are designed so that the area of surfaces of the valve member which are exposed to the fluid pressure in the fluid pressure compartment are dimensioned so that, at least when the valve member is in the first position, the resulting force of the fluid pressure on the valve member tends to move the valve member towards its second position.

When the valve member is in its second position, the fluid pressure compartment and the piston chamber are fluidly disconnected from the main fluid feeding duct.

When the valve member is in its second position, the fluid pressure in the main fluid feeding duct is applied on a snake of the valve member which is substantially perpendicular to the movement of the valve member, so that the resulting effort of the action of the fluid pressure in the main feeding duct on the valve member does not tend to cause any substantial movement of the valve member.

The valve chamber and the valve member define a valve seat where the valve chamber and the valve member are in contact with each other in the second position of the valve member so as to fluidly disconnect the piston chamber and the fluid pressure compartment from the main fluid feeding duct, and whereas, when the valve member is in its first position, the valve member and the valve chamber are separated at the valve seat so as to allow fluid communication between the piston chamber and the fluid pressure compartment and the main fluid feeding duct.

The valve actuation mechanism comprises resilient means to urge the valve member towards its first position.

The means to urge the valve member towards its first position comprise a spring exerting a force along a direction of movement of the valve member.

The valve member moves from its first position to its second position when the resulting fluid pressure force exerted on the spool exceeds the force exerted by the spring.

The valve comprises at least one communication passage which is selectively fluidly connected or not with the main fluid feeding duct depending on the position of the valve member and wherein, when the valve member is in its first position, fluid and/or fluid pressure is circulated/transmitted between the main fluid feeding duct and the piston chamber through said at least one communication passage.

The valve member comprises a peripheral surface by which it is guided in the valve chamber by being in contact with a corresponding internal surface of the valve chamber, wherein said main fluid feeding duct arrives in said inner surface and wherein the valve member comprises a peripheral groove forming a volume in fluidic communication with the communication passage, wherein said peripheral groove is in fluidic communication with the main fluid feeding duct when the valve member is in its first position, and wherein said peripheral groove faces an internal wall surface of the valve chamber when the valve member is in its second position.

The communication passage is a duct extending through the valve member along a longitudinal axis of the valve member and which is in fluidic communication with the peripheral grove thanks to several ducts distributed around the communication duct.

The valve member comprises a plurality of communication grooves provided on an outer peripheral surface of the valve member.

The valve member comprises at least one obtruding member adapted to obtrude at least one on connected to the main fluid feeding duct when the valve member is in its second position.

An outer surface of the valve member comprises slots which face the main fluid feeding duct when the valve member is in its first position and which face an internal wall of the valve chamber when the valve member is in its second position.

The communication passage is a duct extending through the valve member along the longitudinal axis of the valve member and wherein an obtruding member protruding from a surface of the valve chamber obtrudes said communication duct when the valve member is in its second position.

The valve member is a spool adapted to translate along a longitudinal axis of the valve chamber.

The rocker is moved by a camshaft and, in the second position of the activation piston, a cam follower of the rocker is adapted to read at least one auxiliary valve lift sector of a cam of the camshaft so as to perform said engine operating function.

The invention also concerns an automotive vehicle, such as a truck, comprising a valve actuation mechanism as mentioned here-above.

BRIEF DESCRIPTION OF THE DRAWINGS

The invention will now be explained in correspondence with the annexed figures, as an illustrative example. In the annexed figures.

DETAILED DESCRIPTION

Figure 1:
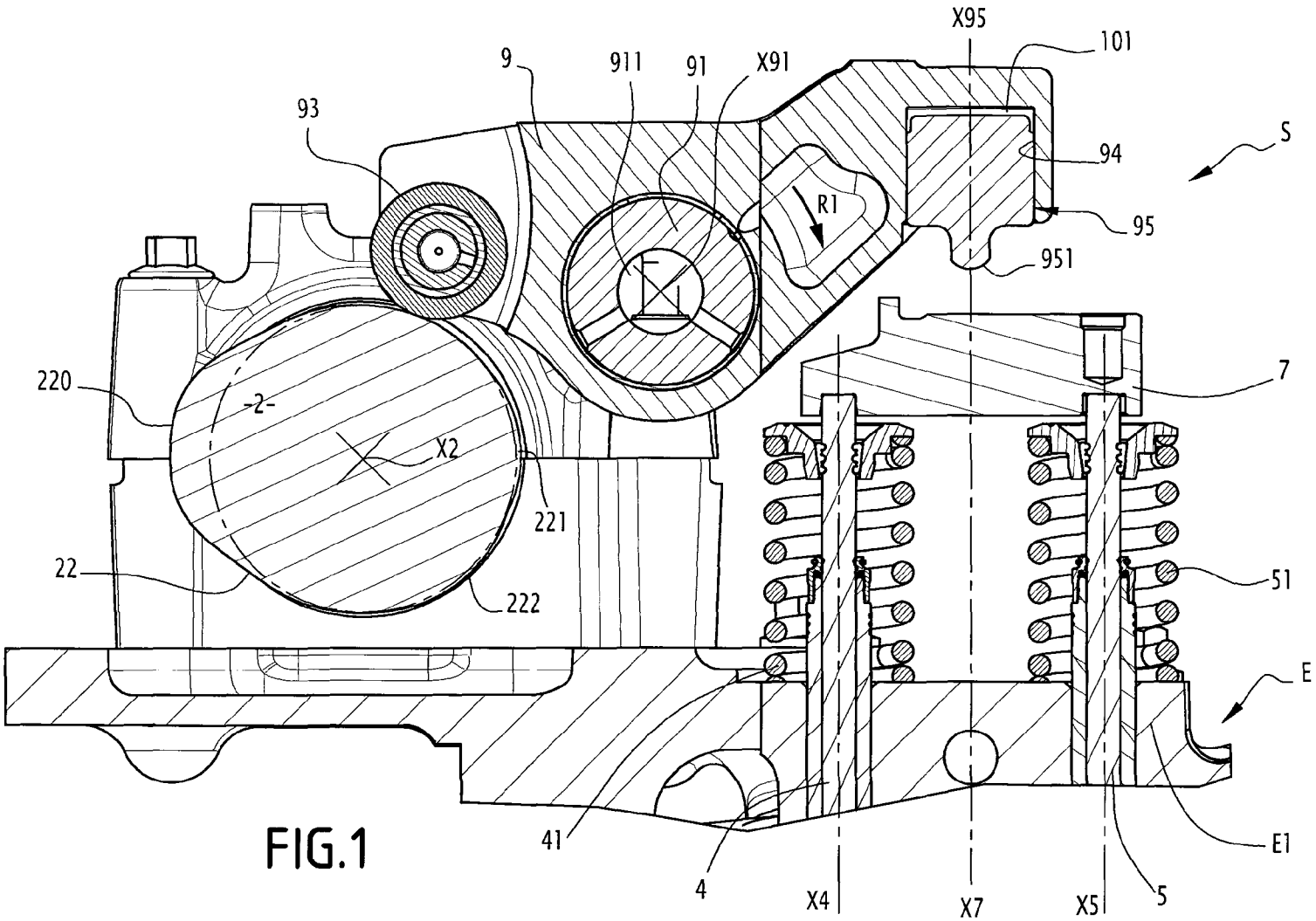
FIG. 1 is a partially sectional view of a valve actuation mechanism according to a first embodiment of the invention.

The valve actuation mechanism S represented on FIG. 1 comprises a camshaft 2 rotatable around a longitudinal axis X2. Camshaft 2 comprises several cams 22, each being dedicated to moving the valves of one cylinder of an internal combustion engine F, of a nonrepresented automotive vehicle, such as a truck, on which valve actuation mechanism S is integrated. Each cam has a cam profile which may comprise one or several "bumps", i.e. valve lift sectors where the cam profile exhibits a bigger eccentricity with respect to axis X2 than the base radius of the cam. FIG. 1 shows a portion of valve actuation mechanism S corresponding to one cylinder of the engine.

In this embodiment, each cylinder of engine E is equipped with two exhaust valves 4 and 5. Valves 4 and 5 are biased towards their closed position by respective springs 41 and 51. Each valve 4 and 5 is movable in translation along an opening axis X4 or X5 so as to be opened, or lifted. More precisely, translation of valves 4 and 5 opens a passageway between the combustion chamber of the cylinder and an exhaust manifold. Valves 4 and 5 are connected to a valve bridge 7, which forms a valve opening actuator, and which extends substantially perpendicular to axes X4 and X5. Valves 4 and 5 are partly represented on the figures, only their respective stems are visible.

For each cylinder, the transmission of movement between camshaft 2 and valve bridge 7 is performed by a rocker 9 rotatable with respect to a rocker shaft 91 defining a rocker rotation axis X91 which in this example is parallel to the axis X2 of the corresponding camshaft. Only one rocker 9 is represented on the figures. Each rocker 9 comprises a roller 93 which acts as a cam follower and cooperates with a cam 22. Roller 93 is located on one side of rocker 9 with respect to shaft 91. Each rocker 9 comprises, opposite to roller 93 with respect to shaft 91 an activation piston 95 adapted to exert a valve opening force on valve bridge 7, which is connected to valves 4 and 5, for example merely by being in contact with the valve stems.

The plane defined by the axes X4, X5 of the valves is perpendicular to the rotation axis X91 of the rocker 9. In this example valve 5 is farther away from the rocker rotation axis X91 than valve 4, but other configurations are possible. Also, the rocker 9 could be in direct contact with one of the exhaust valves, in which case the valve opening actuator may be formed for example by the valve stem itself.

Rotation of camshaft 2 transmits, when the roller runs against a valve lift sector of the cam, a rotation movement R1 to rocker 9 via roller 93, this rotation movement inducing a translation movement of valve bridge 7 via activation piston 95, along an axis X7 which is parallel to axes X4 and X5. Cooperation between a main valve lift sector of cam 22 and roller 93, on the one hand, and between piston 95 valve bridge 7, on the other hand, generates exhaust openings of valves 4 and 5 during the corresponding operating phase of internal combustion engine E. The rocker has an alternate rotation movement and can therefore rotate between a valve closing position and a valve opening position, depending on the cam profile. Thereby, in this embodiment, the rocker 9 is directly driven by a camshaft. In other embodiments of the invention, the rocker could be indirectly driven by a cam shaft, through a transmission mechanism, or could be driven by another type of actuator, for example a hydraulic or pneumatic actuator. The invention can also be implemented in the context of a so-called single valve brake configuration where the rocker drives two exhaust valves but where the activation piston of the rocker may drive only one of these two valves for performing an opening of only that valve.

In the embodiment of FIG. 1 to 5, rocker shaft. 91 is hollow and defines a duct 911 which houses a fluid circuit coming from a non-shown fluid pressure source of valve actuation mechanism S. Rocker 9 comprises itself an internal fluid circuit which connects duct 911 to a piston chamber 101 of rocker 9, partly delimited by piston 95, via a controlled blocking valve 97. Activation piston 95 is housed in a bore 94 of rocker 9 and adapted to move with respect to chamber 101, delimited by the bore 94 and the piston 95, along a translation axis X95 corresponding to a longitudinal axis of piston 95. A main feeding duct 912 is arranged in the rocker 9 and fluidly connects duct 911 to controlled blocking valve 97. A duct 913 fluidly connects controlled blocking, valve 97 to piston chamber 101.

When engine E is in a normal motoring mode, the pressure delivered at duct 911 is at a low level, for example at atmospheric pressure. When engine F switches to engine brake mode, a non-shown engine brake control valve delivers pressurized fluid to ducts 911 and 912, for example at a higher pressure level which can be in the order of 3 bars, which entails that pressurized fluid flows through blocking valve 97 in piston chamber 101. The pressure raise in chamber 101 induces a translation movement of piston 95 outwardly with respect to rocker 9, from a first position, in which piston 95 is entirely or partially pushed back into chamber 101 i.e. retracted, to a second position, in which piston 95 is partially moved out of piston chamber 101, i.e. extended, until it comes in abutment against valve bridge 7. Preferably, the control fluid is a substantially incompressible fluid, such as oil.

Cam 22 comprises in this embodiment two auxiliary valve lift sectors which are adapted to cooperate with roller 93. These sectors induce, when read by roller 93 of rocker 9, two additional pivoting movements of rocker 9 on each turn of camshaft 2. The auxiliary lift sectors are usually designed to cause only a limited lift of the valve, as they are not intended to allow a great flow of gases through the valve. Typically, the lift caused by the auxiliary valve lift sectors is less than 30 percent of the maximum valve lift value. When the piston 95 is in the extended position, these pivoting movements are transformed by piston 95 into two opening movements of valves 4 and 5 so as to perform an engine brake function at two precise moments during operation of engine E as described briefly above. The purpose and effects of these valve openings are well-known and will not be further described hereafter. According to an alternate embodiment, cam 22 may comprise only one auxiliary valve lift sector for performing only one opening of valves 4 and 5 on each turn of camshaft 2, in addition to the main exhaust valve opening.

When piston 95 is in its first position, retracted, as shown on FIG. 1, roller 93 is offset with respect to the auxiliary valve lift sectors of cam 22 by an engine brake actuation clearance, so that when camshaft 2 rotates around axis X2, cam 22 does not come in contact with roller 93, or piston 95 does not come in contact with valve bridge 7. The clearance is such that the auxiliary valve lift sectors cannot cause the opening of valves 4 and 5, because the rotation of the rocker induced by the auxiliary valve lift sectors is too limited to compensate for the clearance between activation piston 97 and valve bridge 7 or between roller 93 and cam 22. To the contrary, a main valve lift, sector causes a displacement of the rocker 9 around its axis which is sufficient to cause opening of both valves.

Figure 3:
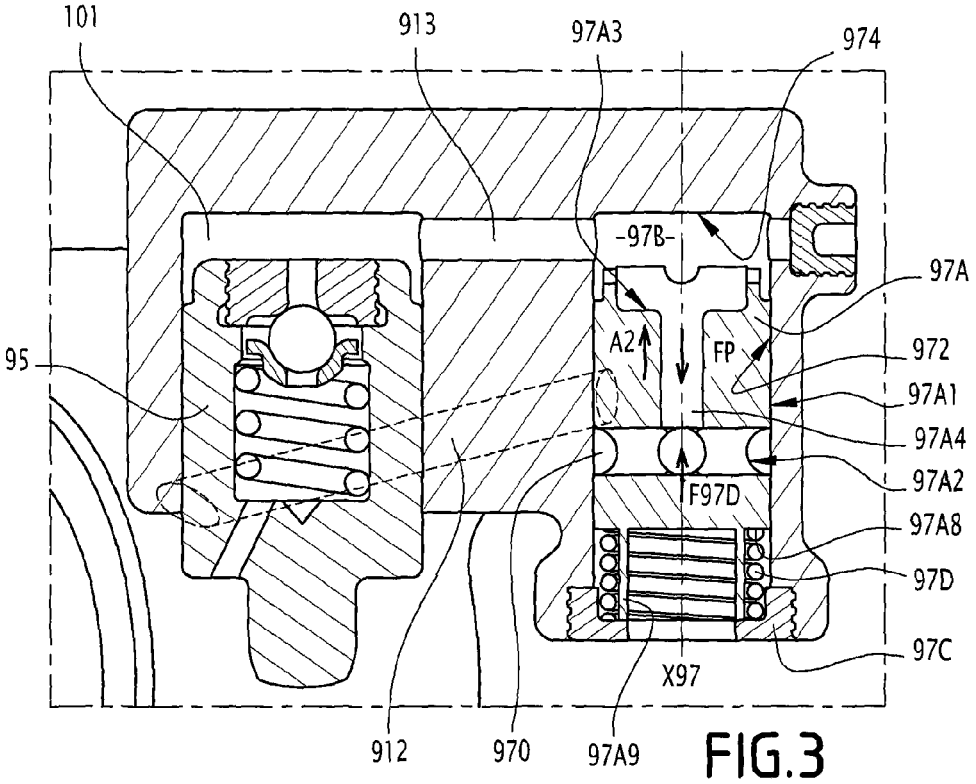
FIG. 3 is a sectional view along line III on FIG. 2, at a larger scale.
Figure 4:
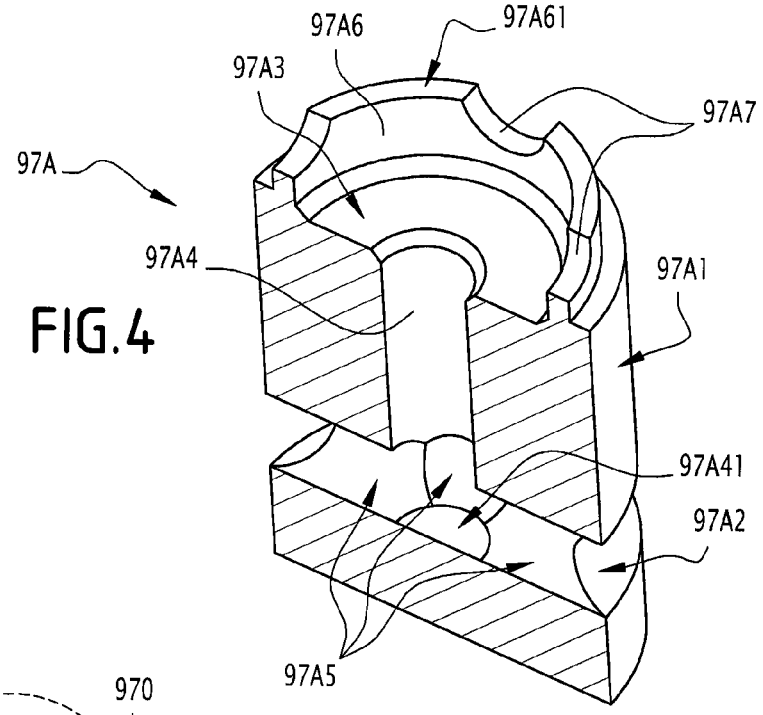
FIG. 4 is a sectional perspective view of a spool belonging to the valve actuation mechanism of FIGS. 1 to 3.
Figure 5:
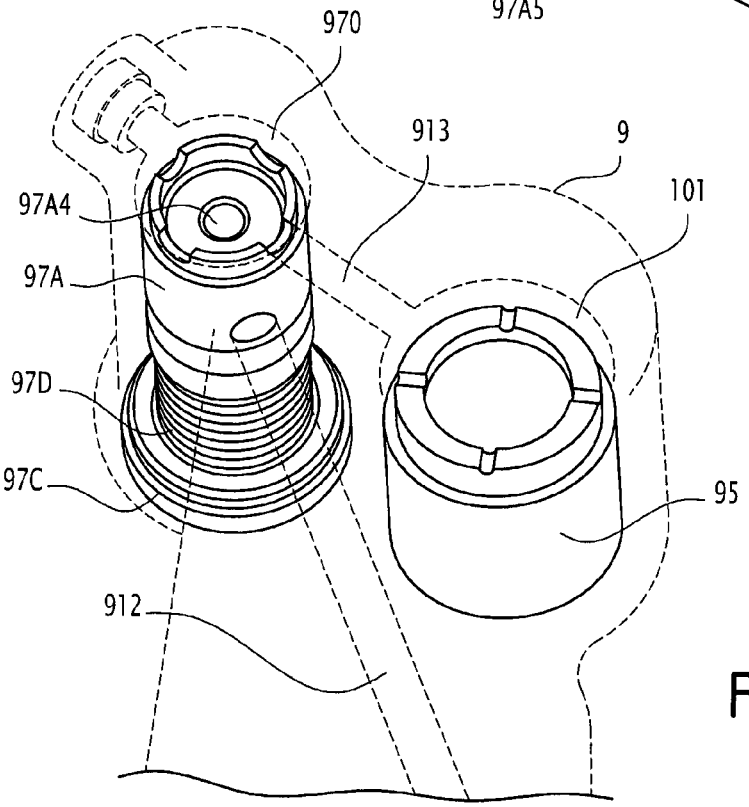
FIG. 5 is a perspective view of a portion of the valve actuation mechanism of FIGS. 1 to 3, as rocker of the mechanism being represented in ghost lines.

By moving piston 95 to its second position, extended, as shown on FIG. 3, rocker 9 pivots around the longitudinal axis X91 of shaft 91. Thus, the actuation clearance is suppressed and roller 93 comes into contact with the auxiliary valve lift sectors of cam 22, while the activation piston 95 is simultaneously in contact or quasi contact with the valve bridge 7, allowing engine brake operations to be implemented when the roller 93 is acted upon by any one of the auxiliary valve lifts.

Controlled blocking valve 97 comprises a valve chamber 970, which, in this example, is a cylindrical bore centred on central longitudinal axis X97. Valve chamber 970 defines a cylindrical internal wall surface 972. Valve chamber 970 opens on one side to the outside of rocker 9, but is closed on the other side by a transverse wall surface 974 perpendicular to axis X97. Valve chamber 970 is in fluidic communication with the chamber 101 of the activation piston 95 and with the main fluid feeding duct 912.

Blocking valve 97 also comprises a valve member 97A, which is moveable in valve chamber 970. The valve member 97A is movable between a first position corresponding to the open state of the blocking valve 97, in which the main fluid feeding duct 912 is fluidly connected to the piston chamber 101, and a second position corresponding to the blocking state of the blocking valve 97, in which the main fluid feeding duct. 912 and the piston chamber 101 are fluidly disconnected.

In the shown embodiments, the valve member 97A consists of a single unitary moveable valve member, with the meaning that, while it may comprise several pans, such parts would be assembled in such a way to behave as one single unitary body, with no substantial nor functional movement between the parts.

In the shown embodiments, valve member 97A is rigid. It is in the form of a spool having a substantially cylindrical shape corresponding to the shape of valve chamber 970, and whose outer cylindrical peripheral surface 97A1 is in sliding contact with the internal cylindrical wall surface 972 of valve chamber 970 in a sliding assembly tight enough to substantially prevent any fluid flow along the interface. Thereby, the spool 97A can move rectilinearly in the valve chamber 970 along axis X97. Therefore, the controlled blocking valve 97 is, in the show examples, in the form of a rectilinearly sliding spool valve. Nevertheless, in view of the invention, the controlled blocking valve could take other forms and could for example be in the form of a rotary spool valve.

In the first embodiment shown in FIG. 1, the duct 912, which fluidly connects duct 911 to controlled blocking valve 97, enters in the cylindrical internal wall surface of the valve chamber 970, approximately in a middle area of valve chamber 970 along axis X97. Duct 913, which fluidly connects blocking valve 97 to piston chamber 101 opens in the vicinity of transverse surface 974 of valve chamber 970 opposed to the open end of valve chamber 970. The volume defined in the valve chamber 970 between the transverse wall surface 974 and the valve member 97A forms a pressure compartment 97B which is permanently fluidly connected to the piston chamber 101, via duct 913, so as to be permanently at the same pressure as the piston chamber 101.

Figure 2:
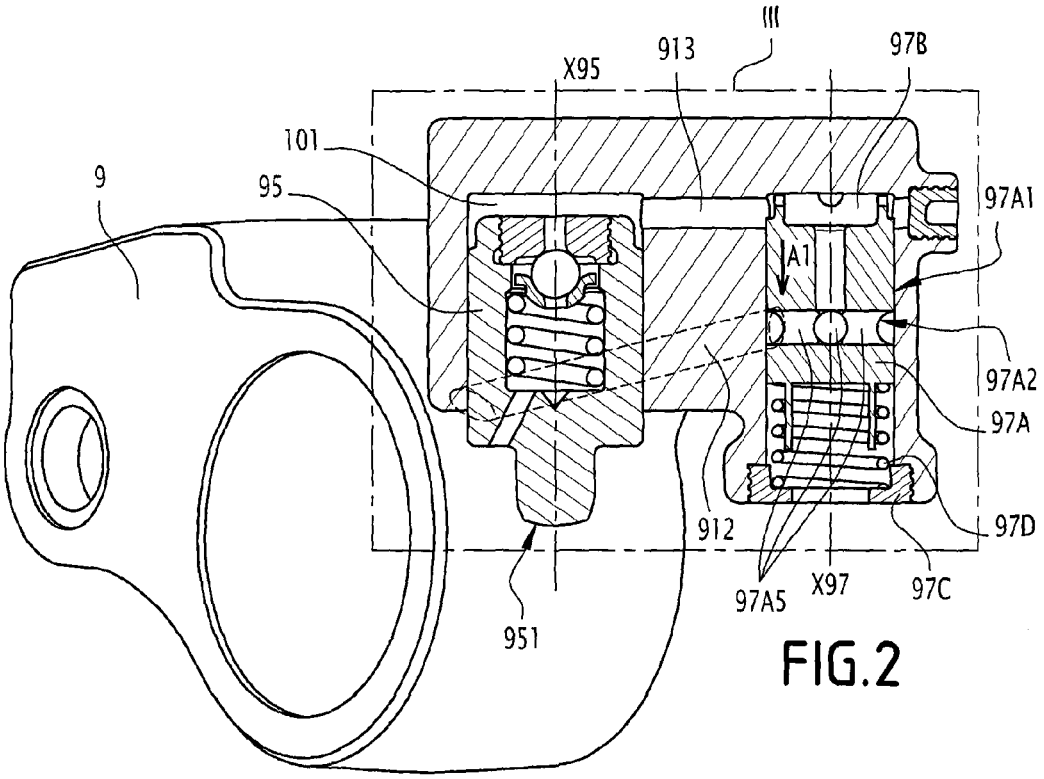
FIG. 2 is a sectional view of a portion of the valve actuation mechanism of FIG. 1.

As indicated above, spool 97A is moveable between a first open position, represented on FIG. 2, in which fluid, can circulate from duct 912 to duct 913 in both directions, and a second blocking position, represented on FIG. 3, in which fluid is blocked by blocking valve 97, at least in the direction from the piston chamber 101 to the main feeding duct 912.

According to a preferred embodiment of the invention, the valve member 97A is exposed to the fluid pressure in such a way that, at least when the valve member 97A is in its first position allowing bidirectional fluid flow through the blocking valve, the resulting force FP of the fluid pressure on the valve member 97A tends to move the valve member 97A towards its second position blocking fluid flow to the fluid feeding circuit 911 through the blocking valve 97.

In this first embodiment of the invention, spool 97A comprises, on its outer surface 97A1, a peripheral groove 97A2 which faces, in the first position of the valve member 970 shown on FIG. 2, the opening of duct 912 in valve chamber 970. Advantageously, groove 97A2 may run on the whole circumference of spool 97A so that no precise orientation of the spool 97A is need around its axis X97. Fluid pressure compartment 97B is fluidly connected to groove 97A2 by a communication duct 97A4, which extends for example along the axis X97 of the spool 97A. Fluid pressure compartment 97B extends between transverse surface 974 of the rocker 9 and annular surface 97A3 of the spool 97A. Annular surface 97A3 extends around an outlet of communication duct 97A4. Communication duct 97A4 is fluidly connected to groove 97A2 by at least one duct 97A5 provided within spool 97A. Advantageously, spool 97A comprises four ducts 97A5, which extend radially from the axis X97 and which are distributed in a cross-shape around communication duct 97A4.

The area of surfaces of the valve member 97A which are exposed to the fluid pressure are dimensioned so that, at least when the valve member 97A is in the first position, the resulting force FP of the fluid pressure on the valve member 97A tends to move the valve member (97A) towards its second position. In this embodiment, Fluid pressure acts in a global fluid pressure zone formed by the contiguous volumes of the chamber 101, of fluid pressure compartment 97B, of groove 97A2, of communication duct 97A4 and ducts 97A5. However, as it will be explained hereafter, the resulting effect of the fluid pressure on the valve member 97A is mainly the effect of the pressure in fluid pressure compartment 97B.

When blocking valve 97 is open, spool 97A is in a position in which an edge 97A61 of peripheral wall 97A6 abuts against transverse surface 974. In this position, fluid can pass from duct 912 to duct 913 via groove 97A2, ducts 97A5, communication duct 97A4, fluid pressure compartment 97B, and openings 97A7. Therefore, spool 97A comprises at least one communication passage, the communication ducts 97A4 and 97A5, which is selectively fluidly connected or not with the main fluid feeding duct 912 depending on the position of spool 97A and, when the spool is in its first position, fluid and/or fluid pressure is circulated/transmitted between the main fluid feeding duct 912 and the piston chamber 101 through said at least one communication passage arranged on spool 97A.

On its end 97A8 located on the side of the open end of valve chamber 970, the spool is not exposed to fluid pressure. At that end 97A8, spool 97A comprises a sleeve 97A9 extending around axis X97. Blocking valve 97 further comprises a stop ring 97C which is screwed in rocker 9 along axis X97 for assembly purposes. A spring 97D is mounted between end 97A8 and stop ring 97C so that it keeps spool 97A, by default, in its first open position as long as engine brake is not activated, i.e. as long as the fluid delivered by the main fluid feeding duct 912 is at low pressure, for example inferior to 2 bars of absolute pressure.

In the blocking state of blocking, valve 97, spool 97A is in its second position, offset along axis X97 with respect to its first position, so that the opening of duct 912 in valve chamber 970 faces outer surface 97A1 of spool 97A. In this position, shown on FIG. 3, groove 97A2 faces internal wall 972. Fluid can therefore not pass from duct 912 to duct 913, neither from duct 913 to duct 912. As a consequence, when spool 97A is in its second position, the fluid pressure compartment 97B and the piston chamber 101 are fluidly disconnected from the main fluid feeding duct 912. Moreover, in this first embodiment, when spool 97A is in its second position, the fluid pressure in the main fluid feeding duct 112 is applied on a surface of spool 97A, here the outer surface 97A1 of spool 97A, which is substantially perpendicular to the movement of spool 97A, so that the resulting effort FP of the action of the fluid pressure in the main feeding duct 112 on the spool does not tend to cause any substantial movement, of spool 97A.

In view of the above, it can be said that the valve chamber 970 and spool 97A define a valve seat where the valve chamber 970 and spool 97A are in contact with each other in the second position of spool 97A so as to fluidly disconnect the piston chamber 101 and the fluid pressure compartment 97B from the main fluid feeding duet 912, and wherein when the spool is in its first position, spool 97A and the valve chamber 970 are separated at the valve seat so as to allow fluid communication between the piston chamber 101 and the fluid pressure compartment 97B and the main fluid feeding duct 912.

With respect to the valve seat, it is possible to define an upstream portion of the fuel fluid circuit in the rocker 9, i.e. on the side of the fluid pressure source, and a downstream portion, on the side of the piston chamber 101.

In this first example, the valve seat is formed of the outlet of the main feeding duct 912 in internal cylindrical wall surface 972 of the chamber 970, and of the corresponding portions of the outer cylindrical surface 97A1 of the spool. Therefore, the valve seat is formed by elements which are generally parallel to the direction of movement of spool 97A, such that the spool movement is generally perpendicular to the general flow direction of fluid through the valve seat. In this configuration, the resulting effort of the action of the fluid pressure in the main feeding duct 912 on the spool 97A does not tend to cause any substantial movement of spool 97A.

When the engine brake valve lifts have to be performed, engine brake is activated with the result that fluid is sent under a control pressure, which can be for example 3 bars, in rocket 9 from duct 911. At this moment, it is assumed that the activation piston 95 is in its inward first position, and blocking valve 97 is assumed to be open, as shown on FIG. 2.

When fluid starts to flow in duct 912, it flows through spool 97A as previously described, then through duct 913 and into piston chamber 101. Piston 95 starts to move outwards from piston chamber 101 under action of fluid pressure. As fluid still flows from duct 912 into valve chamber 970, the fluid pressure in fluid pressure compartment 97B increases, especially once the activation piston has reached its outward second position. The valve chamber 970 and spool 97A are designed so that the area of surfaces of spool 97A which are exposed to the fluid pressure in the fluid pressure compartment 97B are dimensioned so that the resulting force of the fluid pressure on the spool tends to move the spool 97A towards its second position. In the shown embodiment, the resulting pressure force FP exerted by fluid in fluid pressure compartment 97B is exerted on surface 97A3, on edge 97A61 and on a circular surface 97A41 located, at the intersection between ducts 97A5 and communication duct 97A4. The fluid pressure exertion on these surfaces tends to move spool 97A towards its second position. The action of fluid pressure of the upper inner surfaces of ducts 97A5, which may cause movement of spool 97A towards its first position, is counter-balanced by the action of fluid pressure on the lower inner surfaces of ducts 97A5. At this time, spool 97A is kept in its open position by force F97D exerted by spring 97D. The raise of pressure in the pressure compartment 97B implies that the fluid pressure force FP exerted on spool 97A, which is exerted along axis X97 against force 97D, progressively counter-balances force F97D. When force FP exceeds F97D, at the time fluid pressure reaches the control pressure, spool 97A reaches its second position along axis X97, as shown by arrow A1 on FIG. 2.

As fluid still comes in valve chamber 970, spool 97A goes on moving along arrow A1 until it reaches its blocking position, at which fluid at control pressure is prevented from getting in valve chamber 970, as described before. In this configuration represented on FIG. 3, piston 95 is in its outwards position, in which engine brake valve lifts can be performed, and blocking valve 97 is in its blocking state, preventing fluid from getting out of piston chamber 101 to duct 912. Activation piston 95 can therefore not be moved towards its inward first position.

When rotation R1 of rocker 9 reaches an angle at which the valve lift begins, rotation of rocker 9 goes against action of a resisting force exerted by springs 41 and 51 on valve bridge 7. This force suddenly increases the fluid pressure in piston chamber 101, creating a pressure wave inside rocker 9. Consequently, an overpressure occurs in fluid pressure compartment 97B, causing spool 97A to move further downwards along arrow A1. This permits to further "lock" the closing of blocking valve 97 by moving spool 97A in an abutment position, in which sleeve 97A9 is in abutment against stop ring 97C. The pressure in piston chamber 101 further increases due to the force exerted by springs 41 and 51. As this moment, the valves 4 and 5 are lifted to perform the engine brake function.

When these lifts end, valves 4 and 5 close and springs 41 and 51 release their action on valve bridge 7, and therefore on activation piston 95. Fluid pressure in piston chamber 101 then drops to a value substantially equal to the control pressure. Nevertheless, the system is constructed so that some leakage of fluid from the fluid compartment can occur. Because of that leakage, that may occur between valve chamber 970 and the outside of rocker 9 during the time when blocking valve 97 is in its blocking state, pressure in the pressure compartment 97B drops to a value inferior to the control pressure. Such leakage can occur between internal wall 972 and outer surface 97A1, in an area comprised between groove 97A2 and sleeve 97A9, and/or can occur between activation piston 95 and its bore 94. Preferably this leakage occurs essentially when the fluid pressure is at a high level when the activation piston is submitted to the opening effort of the valves which is exerted by the exhaust valve springs 41, 51. When this high effort has ceased, the leakage generates an unbalance of forces exerted on spool 97A in favour of force F97D of the spring. Therefore, after pressure has fallen below a threshold level, spool 97A begins to move towards its first position; i.e. its open position, as shown by arrow A2 on FIG. 3, under the action of spring 97D. Opening of blocking valve 97 goes on until duct 912 faces again groove 97A2. The fluid circuit in rocker 9 allows spool 97A to get back in abutment against transverse surface 974. At this moment, if the valve bridge 7 still exerts an effort on activation piston 95, fluid may start to flow from piston chamber 101, duct 913 and valve chamber 970 into duct 912 and will cause retraction of the activation piston 95. On the other hand, if the activation piston 95 and the valve bridge 7 are not, any more in contact, the pressure in the main fluid feeding duct 12 will be able to cause again the extension of the activation piston 95 to its second outermost position. The next engine brake valve lift cycle can then take place. Any fluid leakage downstream of the valve seat is automatically compensated at each cycle thanks to an automatic short reopening of the blocking valve 97 between a main valve lift and an auxiliary valve lift.

The control of the switching of blocking valve 97 from its open state to its blocking state is obtained solely by the action of the force FP exerted by the fluid pressure in fluid pressure compartment 97B, which is the same as the pressure in piston chamber 101, i.e. by action of fluid pressure downstream of the valve seat. More particularly, the pressure in the piston chamber 101, i.e. the pressure in the downstream portion of the fluid circuit in the rocker 9, is the sole driving factor for switching the blocking valve 97 to its blocking state. In prior art systems, closing of the blocking valve is driven by the pressure upstream of the valve seat, by the fact that it was a piston which was located upstream of the valve seat which wad controlled by the pressure upstream of the valve seat to allow closing of the valve.

Moreover, when the blocking valve 97 is in its blocked stated, the valve member 97A, which controls the switching of the valve, is exposed only to the fluid pressure in the fluid pressure compartment. The fluid pressure in the fluid pressure compartment is considered to be permanently the same pressure as that in the piston chamber 101.

The opening of the blocking valve 97 is caused by the spring 97D when the pressure on the downstream side of the valve seat falls below a given pressure threshold which depends on the geometry of the blocking valve 97 and on the force F97D exerted by the spring. The raises and drops of fluid pressure force FP on spool 97A open or close the fluid passage between duct 912 and duct 913.

The geometry of blocking valve 97 permits to use the same circuit as fluid inlet and outlet in the rocker 9. In other words, fluid is brought to piston chamber 101 via blocking valve 97 from duct 912 and also purged from piston chamber 101 via blocking valve 97 by duct 912. This provides a simple fluidic structure.

In this embodiment as well as in the other embodiments which will be described below, the valve member 97A is a single unitary valve member, the position of which both controls the state of the valve, i.e. Whether the valve is an open state or in its blocking state, depending on the pressure in the piston chamber 101 and controls the effective fluid flow from the chamber 101 to the fluid feeding circuit 911, in that it bears against the valve seat in its second position.

In addition, blocking valve 97 uses only a single specifically produced part, i.e. Spool 97A, together with a spring 97A, to control opening and closing of the fluid circuit in rocker 9. This further improves the simplicity of the system. Moreover, the controlled blocking valve 97 is a two way valve; i.e. Having only two entry-exit ports.

Figure 6:
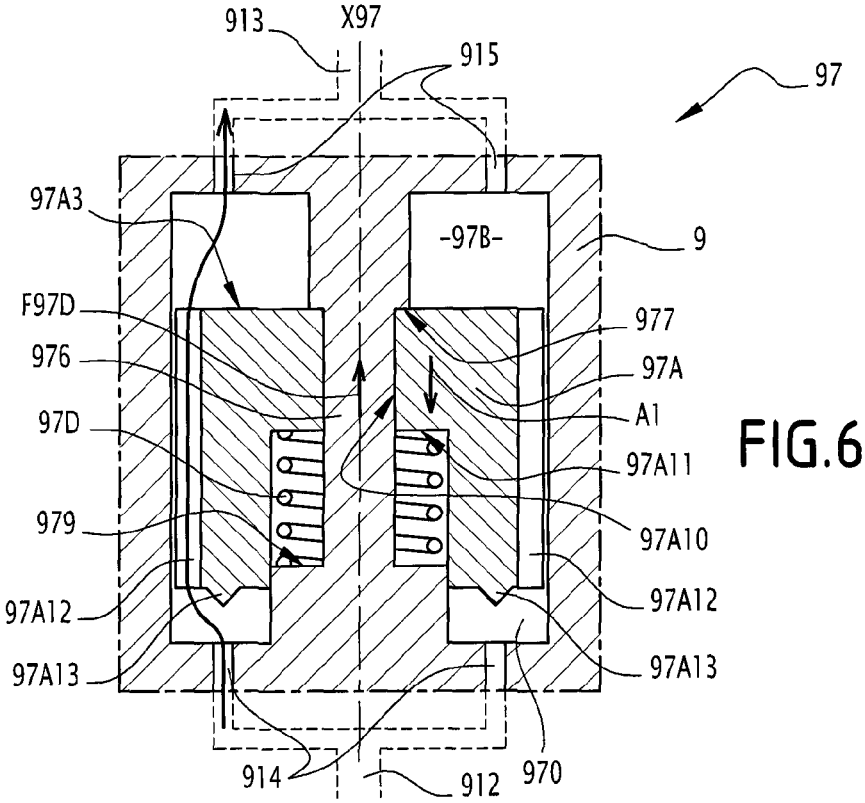
FIGS. 6, 8 and 10 are schematic sectional views of blocking valves belonging to valve actuation mechanisms respectively according to a second, a third and a fourth embodiment of the invention, in an open configuration.
Figure 7:
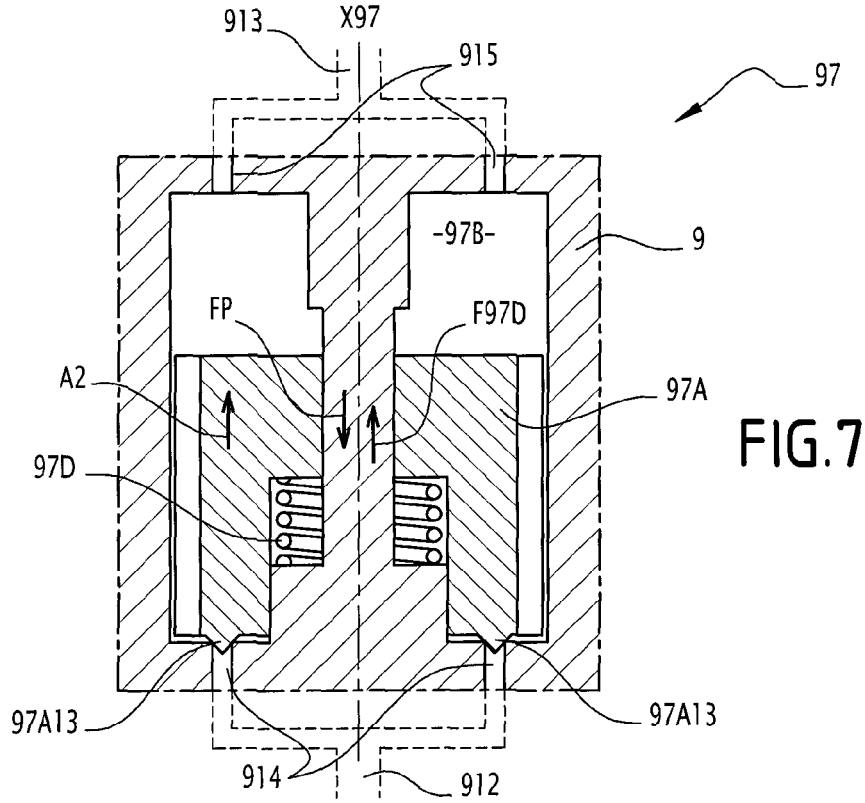
FIGS. 7, 9 and 11 are respectively sectional views of the blocking valves of FIGS. 6, 8 and 10, in a blocking configuration.
Figure 8:
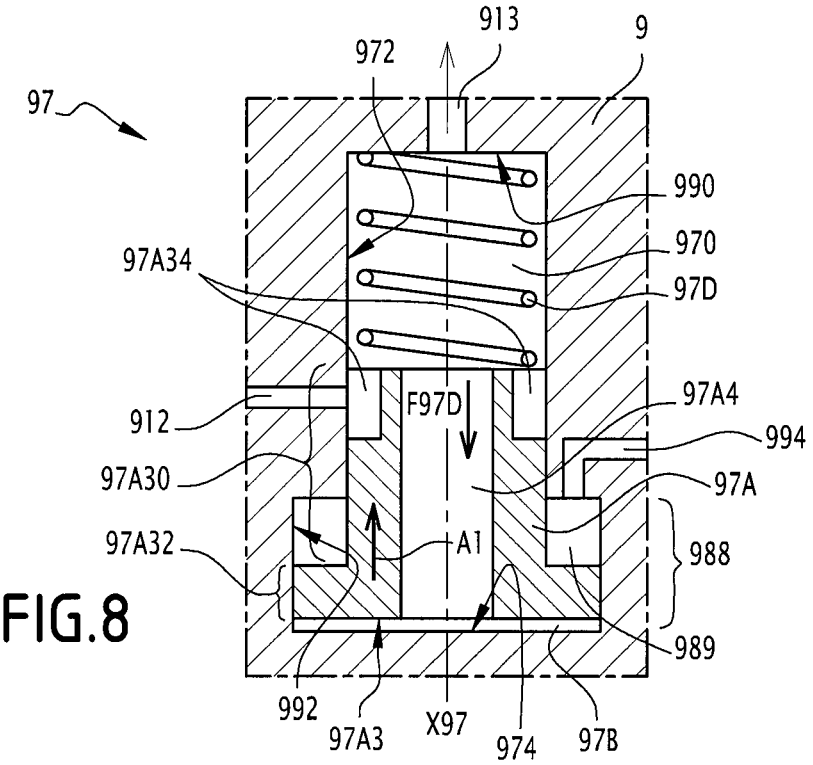
Figure 9:
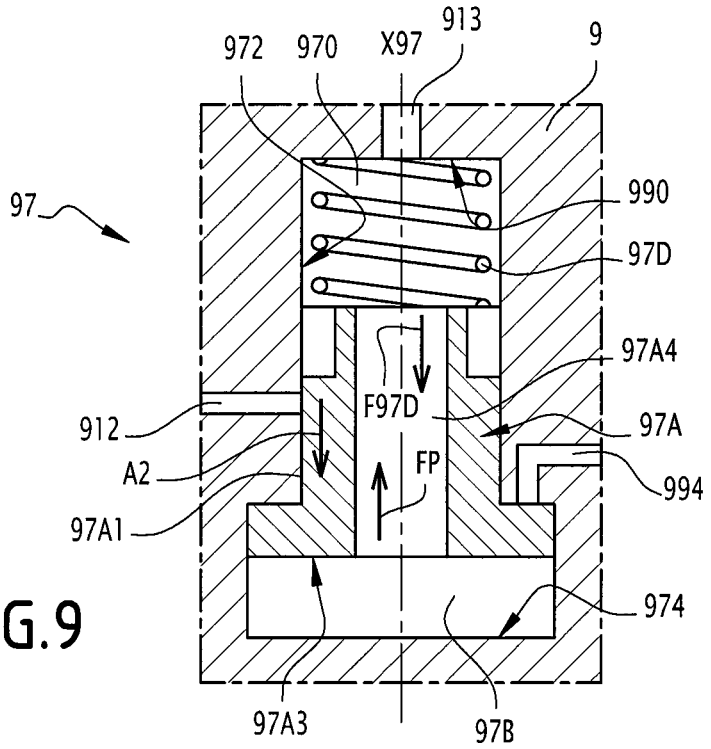
Figure 10:
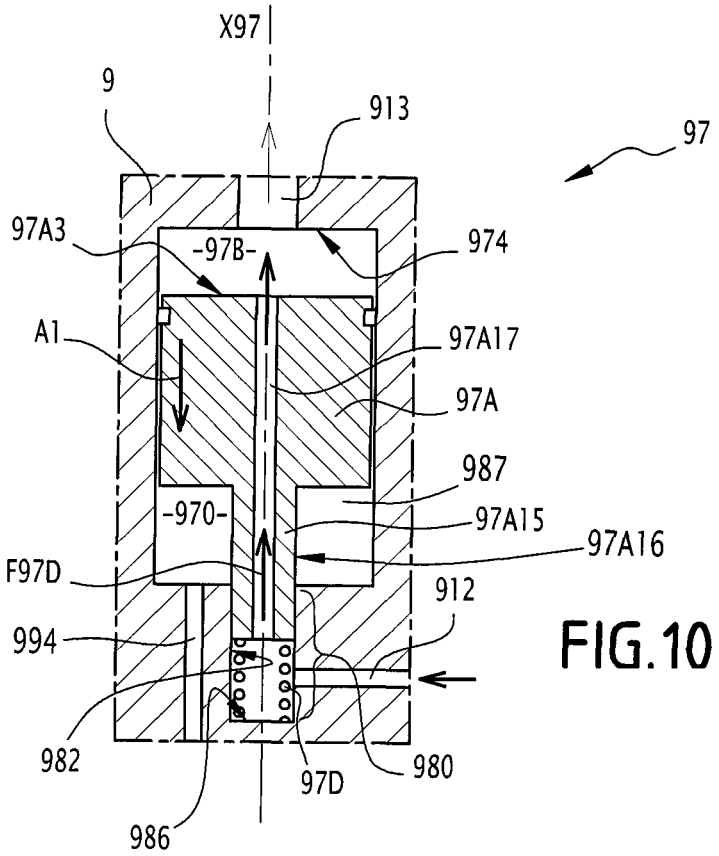
Figure 11:
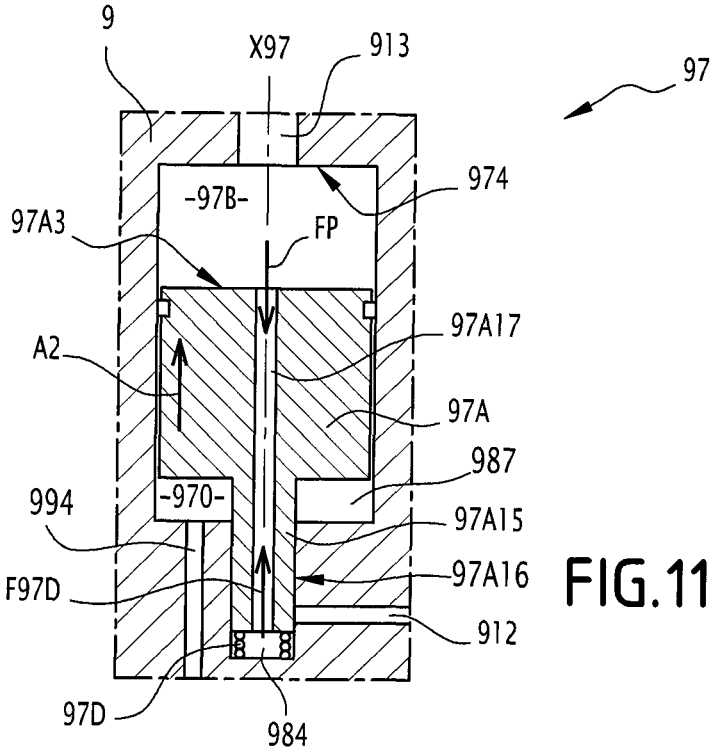

A second, a third and a fourth embodiment of a controlled blocking valve are represented in an open state respectively in FIGS. 6, 8 and 10, and in a blocking state respectively in FIGS. 7, 9 and 11. Elements similar to the ones of the first embodiment have the same references and work in the same way. Only the main differences from the first embodiment are described hereafter.

In the second embodiment shown on FIGS. 6 and 7, spool 97 has a substantially tubular shape extending along axis X97, including a central hole 97A10, also extending along axis X97, Valve chamber 970 has also a tubular shape delimited radially externally by a cylindrical internal surface of the rocker 9, and radially internally by a central pole 976. Spool 97A is mounted along central pole 976, which is received by central hole 97A10. Spool 97A includes an inner transverse shoulder 97A11 which separate two sections of different diameter of the central hole 97A10. Fluid enters in valve chamber 970 from duct 912 through inlet ports 914 which are distributed around central pole 976. Contrary to the first embodiment, the inlet ports are arranged in a transverse upstream wall surface of the chamber 970. On the other side of valve chamber 970, i.e. on a downstream side of the valve, outlet ports 915 are arranged in a transverse downstream wall and are distributed around central pole 976 to permit fluid flow towards duct 913 and piston chamber 101.

On its cylindrical outer surface 97A1, spool 97A comprises communication one or several grooves 97A12, which are substantially parallel to axis X97, and permit fluid flow from ports 914 to fluid compartment 97B, and inversely, through blocking valve 97.

In its first position represented on FIG. 6, spool 97A is spring biased against a stop 977 by spring 97D, which is mounted between shoulder 97A11 and a shoulder 979 of central pole 976, on the side of inlet ports 914. Spring 97D is received in a compartment which is preferably free of oil, and which can be advantageously vented to the atmosphere. In this open position, fluid can pass from inlet ports 914 to outlet ports 915 via communication grooves 97A12. The open position of spool 97A implies that obtruding fingers 97A13, protruding from a transverse surface of spool 97A which faces the transverse wall of the chamber 970 on which are arranged the inlet ducts 914, are axially offset from inlet ports 914 along axis X97.

In this second embodiment of a controlled blocking valve, the obtruding fingers 97A13 and the corresponding inlet ports 914 form the valve seat, and it can be seen that the valve seat is formed by elements which are generally perpendicular to the direction of movement of spool 97A, such that spool 97A movement is generally parallel to the general flow direction of fluid through the valve seat. In this configuration, and contrary to the first embodiment, the resulting effort of the action of the fluid pressure in the main feeding duct 912 on spool 97A would tend to cause a movement of spool 97A towards its first position corresponding to the open state of the blocking valve 97. Therefore, it is necessary, in this embodiment, to minimize the surface area on the inlets 914 of the main fluid feeding duct so as to allow easy closing of the controlled blocking valve 97. For that, when the blocking valve 97 is in its blocked, state, the force which may be generated by the pressure of fluid upstream on the obtruding fingers 97A13, should be insubstantial compared to the force exerted by the spring and by the fluid pressure upstream of the valve seat. Preferably, in the second position of the valve member 97A, the equivalent cross section of the valve member 97A exposed to the fluid pressure upstream of the valve seat should be less than 15% of the equivalent cross section of the valve member P7A exposed to the fluid pressure in the fluid pressure compartment 97B.

The switching of blocking valve 97 from its open state to its blocking state is achieved in the same way as in the first embodiment. Increasing, fluid pressure in fluid compartment 97B downstream of the valve seat exerts a resulting force FP on spool 97A which tends to move spool 97A towards its second position. When resulting fluid pressure force FP exceeds spring force 97D, spool 97A is moved, as shown by arrow A1, towards the configuration of FIG. 7 in which obtruding fingers 97A13 prevent fluid from flowing, hack to inlet ports 914.

In this embodiment, the grooves in spool 97A allow a flow of fluid and/or fluid pressure between main fluid feeding duct 912 and piston chamber 101, and more particularly between an upstream side of the valve member and a downstream side of the spool. The grooves have therefore a function similar to that of the communication duct 97A4 of the first embodiment, but are formed on the exterior surface of the spool rather than inside the spool.

The next steps are the same as in the first embodiment.

In the third embodiment of the invention represented on FIGS. 8 and 9, valve chamber 970 comprises a first forward cylindrical portion centred on axis X97 and a second rearward cylindrical portion 988 having a larger diameter and also centred on axis X97. Main fluid feeding duct 912, which is connected to the fluid pressure source, opens on the cylindrical internal wall surface 972 of the first portion of valve chamber 970, which is essentially parallel to the movement of spool 97A. Duct 913, which is connected to the piston chamber 101, opens on a transverse forward surface 990 of the first portion, and faces, along axis X97, transverse rearward surface 974, which is located in portion 988 of valve chamber 970.

Spool 97A is located in the valve chamber 970, so as to move axially between the transverse rearward surface 974 and the transverse forward surface 990 and comprises a first forward portion 97A30 which hears outer surface 97A1, mounted substantially fluid-tight against inner surface 972, and a second rearward portion 97A32 having a larger diameter, mounted substantially fluid-tight against an inner surface 992 which delimits the larger diameter portion 988 of valve chamber 970. Second portion 97A32 bears a transverse annular surface 97A3 turned rearward and facing the transverse rearward surface 974. Spool 97A comprises a communication duct 97A4 which extends from end to end to fluidly connect a forward portion of fluid pressure compartment. 97B in the vicinity of the outlet duct to a rearward portion of the fluid pressure compartment delimited by rearward transverse surfaces 97A3 of the spool and 974 of the valve chamber 970.

Spool 97A comprises one or several slots or an annular external cut-out 97A34 provided on portion 97A30, allowing fluid to flow from duct 912 to duct 913, when spool 97A is in its first position represented on FIG. 8. Spool 97A is urged rearward towards its open position by spring 97D, which is mounted between spool 97D and forward transverse surface 990. A stop is preferably provided so that rearward transverse surfaces 97A3 of the spool and 974 of the valve chamber 970 do not come in contact one to the other, as shown on FIG. 8.

The area of the surfaces of spool 97A which are exposed to fluid pressure in fluid pressure compartment 97B are dimensioned so that the resulting force of fluid pressure on spool 97A tends to move it towards its second blocking position. Valve chamber 970 comprises a compartment 989, within its rearward portion 988 but in front of the rearward section 97A32 of the spool 97A, which is not exposed to fluid pressure. This compartment 989 is preferably exposed to atmospheric pressure, as shown on the figures, thanks to a duct 994 which connects compartment 989 to the outside of the mechanism.

Blocking valve 97 works in the same way as in the first embodiment: when engine brake is needed, fluid in valve chamber 970 is set to control pressure from duct 912 though slots or cut-out 97A34. Fluid pressure exerted on annular surface 97A3 increases, and spool 97D starts to move, upwards, until duct 912 faces outer surface 97A1. At this moment, fluid is prevented from flowing back from duct 913 to duct 912, blocking valve 97 being in its blocking state, as shown on FIG. 9. In this embodiment, the valve seat comprises the outlet of duct 912 in wall 972 of the chamber and the facing portion of the outer cylindrical wall 97A1 of the valve member 97A.

The following steps of the operation on blocking valve 97 occur in the same way as in the first embodiment.

In the fourth embodiment of the invention represented on FIGS. 10 and 11, cylindrical valve chamber 970 includes a cylindrical rearward portion of smaller diameter 980 having a rearward transverse surface 986. Main fluid feeding duct 912 opens on the internal cylindrical wall 982 of smaller rearward portion 980.

In this embodiment, spool 97A has a cylindrical shape similar to the first embodiment and further includes a cylindrical rearward portion 97A15 of smaller diameter adapted to slide in a substantially fluid tight manner in rearward portion 980 of the chamber. Rearward portion 97A15 of the spool has a cylindrical peripheral surface 97A16.

On the forward side of valve chamber 970 with respect to portion 980, duct 913 which connects to piston chamber 101 opens in a forward transverse surface 974.

The fluid pressure compartment 97B of the blocking valve 97 thereby comprises a first zone 978 in front of the spool 97A and a second zone 984 rearward of the rearward portion 97A15 of the spool. These two zones are fluidly connected by a communication duct 97A17 provided through spool 97A and extending along axis X97.

As in the embodiment of FIGS. 8 and 9, valve chamber comprises a compartment 987, within the main portion of the chamber, but rearward of the main portion of the spool, which is not exposed to fluid pressure, and preferably exposed to atmospheric pressure for example thanks to a duct 994.

In its open position represented on FIG. 10, the rearward portion 97A15 of spool 97A is offset along axis X97 with respect to the opening of duct 912 in portion 980, so that fluid can pass from duct 912 to communication duct 97A17 through the spool 97A and then to duct 913. When pressure increases in valve chamber 970, fluid pressure force FP tends to move spool 97A towards its closed position represented on FIG. 11. In this configuration, the open end of duct 912 is shut-off by the peripheral surface 97A16, preventing fluid from passing from duct 912 to communication duct 97A17.

The combination of the end of duct 912 and peripheral surface 97A16 forms a valve seat similar to the one described in the embodiment of FIGS. 8 and 9, i.e. perpendicular to the movement of the spool 97A.

According to a variant of the invention, piston 95 may be adapted to activate or deactivate a different engine operating function, such as an internal exhaust gases recirculation function. This function allows an exhaust valve opening during the intake stroke. By returning a controlled amount of exhaust gas to the combustion process, peak combustion temperatures are lowered. This will reduce the formation of Nitrogen oxides (NOx).

According to a non-shown embodiment of the invention, valve actuation mechanism S may be an intake valve actuation mechanism for moving two intake valves adapted to open passageway between the combustion chamber of the cylinder and an intake manifold. In this case, the activation piston may be adapted to activate or deactivate an intake function based on early or late Miller cycle (Atkinson) which are known to the specialists and not further described hereafter.

The invention claimed is:

1. Valve actuation mechanism for an internal combustion engine on an automotive vehicle; comprising at least one rocker adapted to exert a valve opening force on at least a portion of an opening actuator for opening a cylinder valve, via an activation piston of the rocker movable in a piston chamber of the rocker under action of a fluid pressure raise in the piston chamber, from a first position in which an engine operating function is deactivated to a second position, in which the engine operating function is performed, the rocker comprising a controlled blocking valve having an open state adapted to allow bidirectional fluid flow between a fluid feeding circuit of the rocker and the piston chamber, and a blocking state to block fluid flow from the piston chamber to the fluid feeding circuit to block the activation piston is in its second position, wherein, the control of the blocking valve between its open state and its blocking state is performed by action of a force exerted by the fluid pressure in the piston chamber on a valve member of the blocking valve which is exposed to the fluid pressure in the piston chamber, wherein the valve member is exposed to the fluid pressure in such a way that, at least when the valve member is in a first position allowing bidirectional fluid flow through the blocking valve, the resulting force of the fluid pressure on the valve member tends to move the valve member towards a second position blocking fluid flow to the fluid feeding circuit through the blocking valve, and wherein the area of surfaces of the valve member which are exposed to the fluid pressure are dimensioned so that, at least when the valve member is in the first position, the resulting force of the fluid pressure on the valve member tends to move the valve member towards its second position.

2. Valve actuation mechanism according to claim 1, wherein the controlled blocking valve comprises a single unitary moveable valve member, which controls both the state of the blocking valve and the effective fluid flow from the piston chamber to the fluid feeding circuit.

3. Valve actuation mechanism according to claim 1, wherein the valve member is movable in a valve chamber which is in fluidic communication with the chamber of the activation piston and with a main fluid feeding duct.

4. Valve actuation mechanism for an internal combustion engine on an automotive vehicle, comprising at least one rocker adapted to exert a valve opening force on at least a portion of an opening actuator for opening a cylinder valve, via an activation piston of the rocker movable in a piston chamber of the rocker under action of a fluid pressure raise in the piston chamber, from a first position in which an engine operating function is deactivated to a second position, in which the engine operating function is performed, the rocker comprising a controlled blocking valve having an open state adapted to allow bidirectional fluid flow between a fluid feeding circuit of the rocker and the piston chamber, and a blocking state to block fluid flow from the piston chamber to the fluid feeding circuit to block the activation piston is in its second position, wherein, the control of the blocking valve between its open state and its blocking state is performed by action of a force exerted by the fluid pressure in the piston chamber on a valve member of the blocking valve which is exposed to the fluid pressure in the piston chamber, wherein the valve member is movable in a valve chamber which is in fluidic communication with the chamber of the activation piston and with a main fluid feeding duct, wherein a first position of the valve member corresponds to the open state of the controlled blocking valve, in which the main fluid feeding duct is fluidly connected to the piston chamber, and a second position of the valve member corresponds to the blocking state of the controlled blocking valve, in which the main fluid feeding duct and the piston chamber are fluidly disconnected.

5. Valve actuation mechanism for an internal combustion engine on an automotive vehicle, comprising at least one rocker adapted to exert a valve opening force on at least a portion of an opening actuator for opening a cylinder valve, via an activation piston of the rocker movable in a piston chamber of the rocker under action of a fluid pressure raise in the piston chamber, from a first position in which an engine operating function is deactivated to a second position, in which the engine operating function is performed, the rocker comprising a controlled blocking valve having an open state adapted to allow bidirectional fluid flow between a fluid feeding circuit of the rocker and the piston chamber, and a blocking state to block fluid flow from the piston chamber to the fluid feeding circuit to block the activation piston is in its second position, wherein, the control of the blocking valve between its open state and its blocking state is performed by action of a force exerted by the fluid pressure in the piston chamber on a valve member of the blocking valve which is exposed to the fluid pressure in the piston chamber, wherein the valve member is movable in a valve chamber which is in fluidic communication with the chamber of the activation piston and with a main fluid feeding duct, wherein the valve member defines in the valve chamber a fluid pressure compartment which is permanently fluidly connected to the piston chamber so as to be permanently at the same pressure as the piston chamber.

6. Valve actuation mechanism according to claim 5, wherein the valve chamber and the valve member are designed so that the area of surfaces of the valve member which are exposed to the fluid pressure in the fluid pressure compartment are dimensioned so that, at least when the valve member is in the first position, the resulting force of the fluid pressure on the valve member tends to move the valve member towards its second position.

7. Valve actuation mechanism according to claim 5, wherein, when the valve member is in its second position, the fluid pressure compartment and the piston chamber are fluidly disconnected from the main fluid feeding duct.

8. Valve actuation mechanism for an internal combustion engine on an automotive vehicle, comprising at least one rocker adapted to exert a valve opening force on at least a portion of an opening actuator for opening a cylinder valve, via an activation piston of the rocker movable in a piston chamber of the rocker under action of a fluid pressure raise in the piston chamber, from a first position in which an engine operating function is deactivated to a second position, in which the engine operating function is performed, the rocker comprising a controlled blocking valve having an open state adapted to allow bidirectional fluid flow between a fluid feeding circuit of the rocker and the piston chamber, and a blocking state to block fluid flow from the piston chamber to the fluid feeding circuit to block the activation piston is in its second position, wherein, the control of the blocking valve between its open state and its blocking state is performed by action of a force exerted by the fluid pressure in the piston chamber on a valve member of the blocking valve which is exposed to the fluid pressure in the piston chamber, wherein the controlled blocking valve comprises a single unitary moveable valve member, which controls both the state of the blocking valve and the effective fluid flow from the piston chamber to the fluid feeding circuit, wherein, when the valve member is in a blocking position, the fluid pressure in the main fluid feeding duct is applied on a surface of the valve member which is substantially perpendicular to the movement of the valve member, so that the resulting effort of the action of the fluid pressure in the main feeding duct on the valve member does not tend to cause any substantial movement of the valve member.

9. Valve actuation mechanism according to claim 5, wherein the valve chamber and the valve member define a valve seat where the valve chamber and the valve member are in contact with each other in the second position of the valve member so as to fluidly disconnect the piston chamber and the fluid pressure compartment from the main fluid feeding duct, and wherein, when the valve member is in its first position, the valve member and the valve chamber are separated at the valve seat so as to allow fluid communication between the piston chamber and the fluid pressure compartment and the main fluid feeding duct.

10. Valve actuation mechanism for an internal combustion engine on an automotive vehicle, comprising at least one rocker adapted to exert a valve opening force on at least a portion of an opening actuator for opening a cylinder valve, via an activation piston of the rocker movable in a piston chamber of the rocker under action of a fluid pressure raise in the piston chamber, from a first position in which an engine operating function is deactivated to a second position, in which the engine operating function is performed, the rocker comprising a controlled blocking valve having an open state adapted to allow bidirectional fluid flow between a fluid feeding circuit of the rocker and the piston chamber, and a blocking state to block fluid flow from the piston chamber to the fluid feeding circuit to block the activation piston is in its second position, wherein, the control of the blocking valve between its open state and its blocking state is performed by action of a force exerted by the fluid pressure in the piston chamber on a valve member of the blocking valve which is exposed to the fluid pressure in the piston chamber, wherein the controlled blocking valve comprises a single unitary moveable valve member, which controls both the state of the blocking valve and the effective fluid flow from the piston chamber to the fluid feeding circuit, wherein the mechanism comprises resilient means to urge the valve member towards a first position.

11. Valve actuation mechanism according to claim 10, wherein the valve member is exposed to the fluid pressure in such a way that, at least when the valve member is in a first position allowing bidirectional fluid flow through the blocking valve, the resulting force of the fluid pressure on the valve member tends to move the valve member towards a second position blocking fluid flow to the fluid feeding circuit through the blocking valve, and wherein the valve member moves from its first position to its second position when the resulting fluid pressure force exerted on the spool exceeds the force exerted by the spring.

12. Valve actuation mechanism for an internal combustion engine on an automotive vehicle, comprising at least one rocker adapted to exert a valve opening force on at least a portion of an opening actuator for opening a cylinder valve, via an activation piston of the rocker movable in a piston chamber of the rocker under action of a fluid pressure raise in the piston chamber, from a first position in which an engine operating function is deactivated to a second position, in which the engine operating function is performed, the rocker comprising a controlled blocking valve having an open state adapted to allow bidirectional fluid flow between a fluid feeding circuit of the rocker and the piston chamber, and a blocking state to block fluid flow from the piston chamber to the fluid feeding circuit to block the activation piston is in its second position, wherein, the control of the blocking valve between its open state and its blocking state is performed by action of a force exerted by the fluid pressure in the piston chamber on a valve member of the blocking valve which is exposed to the fluid pressure in the piston chamber, wherein the valve member is exposed to the fluid pressure in such a way that, at least when the valve member is in a first position allowing bidirectional fluid flow through the blocking valve, the resulting force of the fluid pressure on the valve member tends to move the valve member towards a second position blocking fluid flow to the fluid feeding circuit through the blocking valve, wherein the valve member comprises at least one communication passage which is selectively fluidly connected or not with the main fluid feeding duct depending on the position of the valve member and wherein, when the valve member is in its first position, fluid and/or fluid pressure is circulated/transmitted between the main fluid feeding duct and the piston chamber through the at least one communication passage.

13. Valve actuation mechanism according to claim 12, wherein the valve member comprises a peripheral surface by which it is guided in the valve chamber by being in contact with a corresponding internal surface of the valve chamber, wherein the main fluid feeding duct arrives in the inner surface and wherein the valve member comprises a peripheral groove forming a volume in fluidic communication with the communication passage (97A4), wherein the peripheral groove (97A2) is in fluidic communication with the main fluid feeding duct when the valve member is in its first position, and wherein the peripheral groove faces an internal wall surface of the valve chamber when the valve member is in its second position.

14. Valve actuation mechanism according to claim 13, wherein the communication passage is a duct extending through the valve member along a longitudinal axis of the valve member and which is in fluidic communication with the peripheral groove thanks to several ducts distributed around the communication duct.

15. Valve actuation mechanism according to claim 12, wherein the valve member comprises a plurality of communication grooves provided on an outer peripheral surface of the valve member.

16. Valve actuation mechanism according to claim 15, wherein the valve member comprises at least one obtruding member adapted to obtrude at least one port connected to the main fluid feeding duct when the valve member is in its second position.

17. Valve actuation mechanism according to claim 12, wherein an outer surface of the valve member comprises slots which face the main fluid feeding duct when the valve member is in its first position and which face an internal wail of the valve chamber when the valve member is in its second position.

18. Valve actuation mechanism according to claim 12, wherein the communication passage comprises a duct extending through the valve member along the longitudinal axis of the valve member and wherein an obtruding member protruding from a surface of the valve chamber obtrudes the communication duct when the valve member is in its second position.

19. Valve actuation mechanism according to claim 2, wherein the valve member is a spool adapted to translate along a longitudinal axis of the valve chamber.

20. Valve actuation mechanism according to claim 1, wherein the mechanism is one of:

an exhaust valve actuation mechanism:

wherein the activation piston activates an exhaust gases recirculation function when it is in its second position; or wherein the activation piston activates an engine brake function when it is in its second position; or an intake valve actuation mechanism.

21. Valve actuation mechanism according to claim 1, wherein the rocker is moved by a camshaft and wherein, in the second position of the activation piston, a cam follower of the rocker is adapted to read at least one auxiliary valve lift sector of a cam of the camshaft so as to perform the engine operating function.

22. An automotive vehicle, comprising a valve actuation mechanism according to claim 1.

* * * * *